US010428626B2

(12) United States Patent
Durrani et al.

(10) Patent No.: US 10,428,626 B2
(45) Date of Patent: Oct. 1, 2019

(54) PRODUCTION ESTIMATION IN SUBTERRANEAN FORMATIONS

(75) Inventors: Javaid Durrani, Houston, TX (US); Alpay Erkal, Houston, TX (US); Helena Gamero-Diaz, Frisco, TX (US); Xicai Liu, Katy, TX (US); Marc Jean Thiercelin, Dallas, TX (US); Gisele Thiercelin, legal representative, Dallas, TX (US); Ian C. Walton, Frisco, TX (US); Wenyue Xu, Sugar Land, TX (US); Ruhao Zhao, Irving, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 13/275,118

(22) Filed: Oct. 17, 2011

(65) Prior Publication Data

US 2012/0239363 A1 Sep. 20, 2012

Related U.S. Application Data

(60) Provisional application No. 61/394,089, filed on Oct. 18, 2010.

(51) Int. Cl.
*E21B 43/00* (2006.01)

(52) U.S. Cl.
CPC ..... *E21B 43/00* (2013.01)

(58) Field of Classification Search
None
See application file for complete search history.

(56) References Cited

U.S. PATENT DOCUMENTS

2004/0122640 A1* 6/2004 Dusterhoft ..... 703/10
2006/0235618 A1* 10/2006 Wu ..... G01V 1/46 702/6

(Continued)

FOREIGN PATENT DOCUMENTS

WO 2008048455 A2 4/2008

OTHER PUBLICATIONS

Khan et al., Prediction of Production-Induced Changes in Reservoir Stress State Using Numerical Model, 1996, Society of Petroleum Engineers, pp. 1-11.*

(Continued)

*Primary Examiner* — Omar F Fernandez Rivas
*Assistant Examiner* — Bernard E Cothran

(57) ABSTRACT

A system has a tool capable of obtaining data that characterizes a stimulated reservoir or from which the stimulated reservoir can be characterized. The system also includes a processor capable of predicting the production of the stimulated reservoir using the characterizing data and outputting the predicted production. A reservoir may be stimulated using a stimulation process and data may be obtained that characterizes the stimulated reservoir or from which the stimulated reservoir can be characterized. The production of the stimulated reservoir may be predicted using the data. Alternatively, a reservoir may be stimulated using a stimulation process and data that characterizes the stimulated reservoir or from which the stimulated reservoir can be characterized may be obtained. One or more 3-D volumes may be produced based on the characterizing data, and inferences about the stimulated reservoir may be made using the one or more 3-D volumes.

5 Claims, 2 Drawing Sheets

(56) References Cited

U.S. PATENT DOCUMENTS

| | | | | |
|---|---|---|---|---|
| 2007/0156377 | A1 | 7/2007 | Gurpinar et al. | |
| 2007/0183260 | A1 | 8/2007 | Lee et al. | |
| 2007/0272407 | A1 | 11/2007 | Lehman et al. | |
| 2008/0162099 | A1 | 7/2008 | Vega Velasquez | |
| 2008/0183451 | A1 | 7/2008 | Weng et al. | |
| 2008/0208782 | A1 | 8/2008 | Weiss | |
| 2009/0145598 | A1 | 6/2009 | Symington et al. | |
| 2010/0211423 | A1* | 8/2010 | Hehmeyer | E21B 44/00 702/6 |
| 2010/0218941 | A1* | 9/2010 | Ramurthy et al. | 166/250.1 |
| 2010/0307755 | A1 | 12/2010 | Xu et al. | |

OTHER PUBLICATIONS

Brannon et al., Improved Understanding of Proppant Transport Yields New Insight to the Design and Placement of Fracturing Treatments, Sep. 2006, Society of Petroleum Engineers, pp. 1-12.*
Merriam-Webster, Definition of Surface Area, 2018, Merriam-Webster, pp. 1-2.*
Herrera et al. Neural networks in reservoir characterization, Apr. 2006, The Leading Edge, pp. 402-411 (Year: 2006).*
Rouse, Bayesian statistics, 2018, WhatIs.com, pp. 1-5 (Year: 2018).*
International Search Report and Written Opinion of PCT Application No. PCT/US2011/056719 dated May 12, 2012.
Supplemental Search Report issued in European Patent Appl. No. 11834993.5 dated Mar. 24, 2017; 8 pages.
Extended Search Report issued in European Patent Appl. No. 11834993.5 dated Jun. 28, 2017; 10 pages.
Examination Report issued in Australian Patent Application No. 2016202975 dated Jul. 6, 2017; 4 pages.
Teufel et al., "Optimization of Infill Drilling in Naturally-Fractured Tight-Gas Reservoirs—Phase II", U.S. Depeartment of Energy and Industry Cooperative Agreement, New Mexico Institute of Mining and Technology, May 2004, 162 pages.
Campos et al., "Urucu Field Integrated Production Modeling", SPE 128742, Mar. 25, 2010, 21 pages.
Examination report issued Jan. 21, 2019 in corresponding Indian Patent Application No. 2983/CHENP/2013; 9 pages.

* cited by examiner

PRODUCTION ESTIMATION IN SUBTERRANEAN FORMATIONS

RELATED APPLICATIONS

This application claims the benefit of a related U.S. Provisional Application Ser. No. 61/394,089, filed Oct. 18, 2010, entitled "Method for Production Estimation in Subterranean Formations," to Durrani, et al., the disclosure of which is incorporated by reference herein in its entirety.

BACKGROUND

Hydraulic fracturing for stimulation of conventional reservoirs comprises the injection of a high viscosity fracturing fluid at high flow rate to open and then propagate a bi-wing tensile fracture in the formation. With the exception of the near-wellbore region, where a complex state of stress might develop, it is expected that this fracture will propagate normal to the far-field least compressive stress. The length of this tensile fracture can attain several hundred meters during a fracturing treatment of several hours. The fracturing fluid contains proppants, which are well-sorted small particles that are added to the fluid to maintain the fracture open once the pumping is stopped and pressure is released. This allows one to create a high conductivity drain in the formation. Examples of these particles include sand grains and ceramic grains. At the end of the treatment, it is expected to obtain a fracture at least partially packed with proppants. The production of the hydrocarbons will then occur through the proppant pack. The hydraulic conductivity of the fracture is given by the proppant pack permeability and the retained fracture width. Hydraulic fracturing has been successfully applied in very low permeability gas saturated formations (often called unconventional gas reservoirs). These formations include tight-gas sandstones, coal bed methane, and gas shales. While the permeability of tight-gas sandstones is of the order of hundreds of microDarcy, gas shale permeability is of the order of hundreds of nanoDarcies.

Gas shale reservoirs are a special class of clastic reservoirs because they are a complete petroleum system in themselves. They provide the source, the reservoir, and also the seal. However, the depositional environment results in very low rock permeability, usually in the hundreds of nanoDarcy range. The trapped gas cannot easily flow to the wellbore without hydraulic fracturing. Therefore, one current practice to define shale productive reservoirs, as a consequence of hydraulic fracturing, is to map the fractured volume by studying the microseismic energy released by the stimulation process. One example of the stimulation process involves the injection of a fracturing fluid pumped at a very high pressure resulting in the initiation of a fracture zone that is thought to have propagated normal to the far-field least compressive stress. The fracturing fluid (e.g., slick water) is a slurry of well-sorted sand particles of a specified mesh that is pumped to prop the fractures opened. It is this propped volume that defines the estimated stimulated volume (ESV), calculated from microseismic analysis. Current practice is to assume that the ESV from microseismic monitoring has been propped by the fracturing process and represents a good approximation of the reservoir volume being drained.

Because of the localized nature of the reservoir, static reservoir modeling and simulation is rarely done. One practice sometimes used is to divide the reservoir into several (e.g., three) distinct zones with distinct permeability regimes. The reservoir furthest from the wellbore is considered to be the rock least affected by the stimulation process.

Hence, the permeability is extremely low, in the 100 nD range. Closer to the wellbore is a zone of relatively higher permeability, in the 1000 nD range. This zone is thought to be impacted by the stimulation process and consists of a network of complex fractures. Still closer to the wellbore is the highest permeability conductive zone. An alternative to this partition is to add a high conductivity zone which represents the hydraulic fracture and which starts from the wellbore and ends at the end of the zone of relatively higher permeability.

Another commonly used reservoir characterization methodology is to study production data. Decline curves from production data are usually the mainstay of booking reserves. Seismic data are used frequently but are restricted to mapping the stacked data for hazard mitigation by locating features such as faults and karst features. Another use of seismic is to map the zones of maximum and minimum curvature to qualitatively or quantitatively study the density and orientation of fracture swarms.

SUMMARY

A system has a tool capable of obtaining data that characterizes a stimulated reservoir or from which the stimulated reservoir can be characterized. The system also includes a processor capable of predicting the production of the stimulated reservoir using the characterizing data and outputting the predicted production. A reservoir may be stimulated using a stimulation process and data may be obtained that characterizes the stimulated reservoir or from which the stimulated reservoir can be characterized. The production of the stimulated reservoir may be predicted using the data. Alternatively, a reservoir may be stimulated using a stimulation process and data that characterizes the stimulated reservoir or from which the stimulated reservoir can be characterized may be obtained. One or more 3-D volumes may be produced based on the characterizing data, and inferences about the stimulated reservoir may be made using the one or more 3-D volumes. This summary is provided to introduce a selection of concepts that are further described below in the detailed description. This summary is not intended to identify key or essential features of the claimed subject matter, nor is it intended to be used as an aid in limiting the scope of the claimed subject matter.

FIGURES

Figure 1:
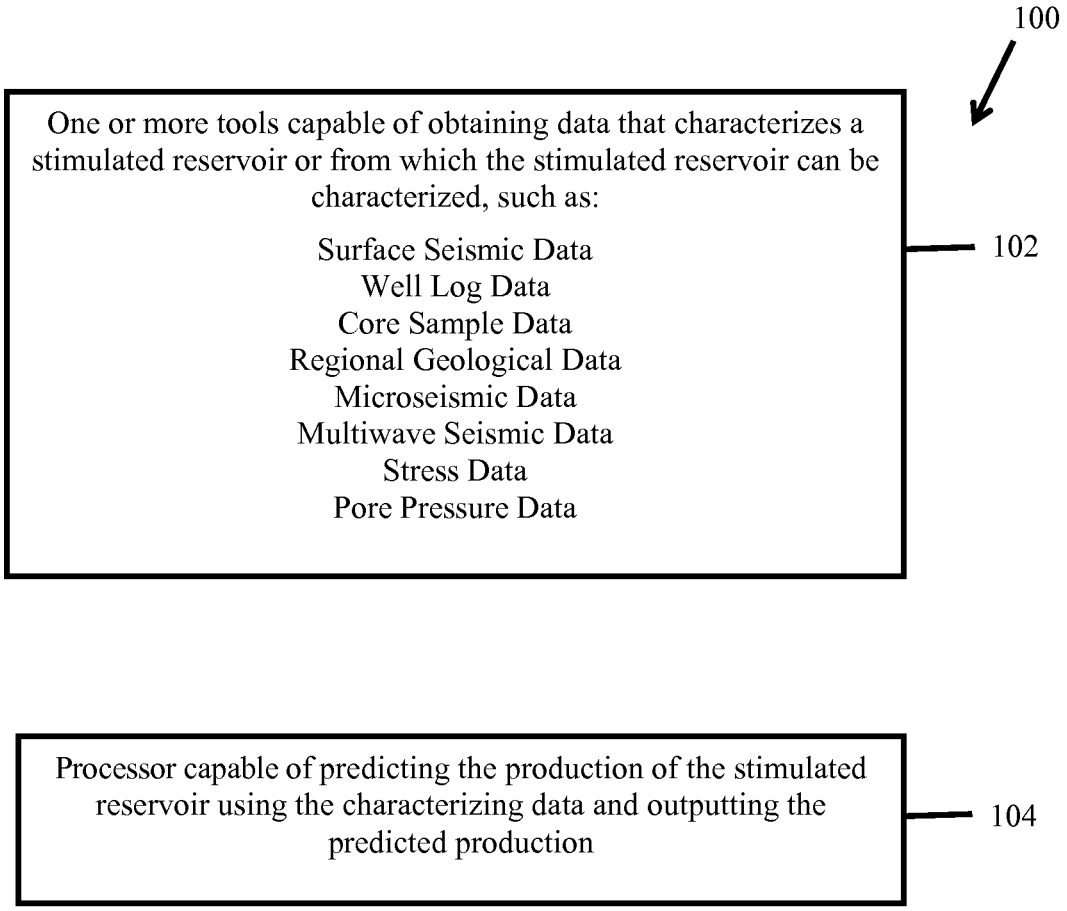
FIG. 1 shows, in the form of a block diagram, a system constructed in accordance with the present disclosure.

It should be understood that the drawings are not necessarily to scale and that the disclosed embodiments are sometimes illustrated diagrammatically and in partial views. In certain instances, details that are not necessary for an understanding of the disclosed method and apparatus or that would render other details difficult to perceive may have been omitted. It should be understood that this disclosure is not limited to the particular embodiments illustrated herein.

DETAILED DESCRIPTION

One or more specific embodiments of the presently disclosed subject matter are described below. In an effort to provide a concise description of these embodiments, not all features of an actual implementation are described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

This disclosure pertains to characterizing a subterranean formation to predict production following the stimulation of the reservoir. Reservoir characterization may involve various disciplines such as surface seismic and a predictive simulator. The characterization may also be iterative and performed any time new data are available, resulting in an updated geomechanical reservoir model at the field scale.

According to one embodiment, inverted elastic, reservoir, and azimuthal anisotropy attributes from prestack seismic data are integrated with available regional geology, well logs, and microseismic data to produce 3-D volumes of elastic and reservoir properties together with fracture densities. These 3-D volumes may be input to stress modeling packages to predict the 3-D stress state. The elastic properties and the 3-D stress state can be input into a network fracture propagation model that predicts the propped fracture surface area. The obtained fracture conductivity may be used in a production model to predict the production from the investigated subterranean formation.

The integration of all available information to produce a field level, as opposed to well specific, model of geomechanical and reservoir properties makes the model robust. Integrating all available information at field scale allows for better prediction of specific stress and reservoir conditions at a projected well location. In addition, the model results can be continuously updated as new wells are drilled, logged, stimulated, and produced.

A new workflow permits the characterization of a subterranean formation to predict the production following the stimulation of the reservoir. One application is the optimization of production from shale gas reservoirs.

In addition to performing mapping and curvature analysis on the seismic data, one may extract additional information to predict reservoir properties (such as porosity, permeability, Total Organic Content, clay content, density), elastic properties (such as static Young modulus, static Poisson ratio, and static shear modulus), and natural fracture attributes (such as density and azimuth) for a 3-D volume imaged by this seismic data. Log and core data provide information from and near the well. However, spatial resolution of the seismically predicted attributes, calibrated to the well data, may be, for example, at a 55×55 foot grid, depending on acquisition geometry and data processing of the surface seismic. Compared to well data and core data, the depth (or temporal) resolution of seismic data is limited. However, the dense spatial sampling of the seismic information makes it a very attractive tool to robustly populate elastic and reservoir attributes away from the well.

Off-the-shelf, prestack seismic data can be used in attribute prediction. If the seismic data have dense acquisition geometry and a wide azimuth, they can be reprocessed to give information on fracture azimuth, fracture density, and fracture fluid. The inversion algorithm can be model-based or statistical. Initially, the predicted attributes are deterministic. However, nothing prevents adding probabilistic constraints to the predicted attributes.

The resulting 3-D map of reservoir properties, especially the elastic properties and the stress variation, may be used to select the landing points of lateral wells (usually zones with good reservoir quality and low value for the least principal stress) and design the completion (stages are selected to isolate relatively constant stress zones along the lateral, while the perforation clusters are shot in the lowest stress zone within a stage). The outcome of the 3-D map may also be used in a fracture network propagation model to characterize the stimulation treatment and predict the created fractured surface area and the productive surface area. Microseismic data may also be used for this characterization, at least in some wells. The primary productive surface area is effectively the propped surface area, although data from the non-propped surface area can be included, if desired. The output of the fracture network propagation model may be used in a production model to predict the production.

The production model uses one or more outputs of the 3-D reservoir model such as porosity and permeability of the rock matrix. The production model can also be used to analyze existing production by using the output of the 3-D geomechanical reservoir model to better understand the controlling parameters such as reservoir quality attributes (porosity and permeability, etc) and completion quality attributes (stress state and natural fractures). This allows one to understand the role of natural fractures in gas shale production. The production analysis of existing wells may be used to validate the full workflow by determining whether this workflow is able to predict the production of those existing wells.

To optimize production, changes in the stimulation job parameters that result in changes in production prediction can be investigated. The best design is generally selected for the treatment. Production measurement can then be used to validate the prediction.

In another embodiment, the petrophysical properties of the subterranean formation, such as the porosity, permeability, Total Organic Content (TOC), Vclay, and density are determined from conventional log data and geochemical log data. Further, determination of the structural dip, maximum and minimum horizontal stress orientations, and fracture characterization (such as density, spacing, orientation, natural versus induced, sealed versus open) is made using image log data. These 3-D volumes of reservoir properties are input along with acoustic and elastic properties and minimum stress and pore pressure in the subterranean formation from data obtained, for example, from sonic logs or stress tools or pore pressure measurement tools. The 3-D volumes of elastic and reservoir properties account for the determination of the well location from deviation survey data when done for existing wells, or from planned deviations when done for future wells. The geologic framework of shale reservoirs, including well log correlation, the relation between fractures, TOC, and current and paleontological stress regimes may be determined.

The 3-D volumes of elastic and reservoir properties may also be used in conjunction with seismic interpretation data, tied to well tops. For poststack seismic data, it is possible to perform curvature analysis to highlight subtle faults and fracture swarms. It is also possible to include prestacked seismic data processed for Amplitude Versus Angle and Azimuth (AVAZ) to determine the fracture anisotropy direction, fracture density, and fracture fluid content. The 3-D volumes of elastic and reservoir properties include prestack inversions (deterministic or stochastic) that allow one to recover acoustic impedance, shear impedance, compressional velocity, shear velocity, Poisson's ratio, and density from seismic data.

In addition, a neural net training step may be performed to predict acoustic, reservoir, and elastic properties that define the reservoir quality (e.g., porosity, permeability, Total Organic Content (TOC), Vclay and density) from well attributes like acoustic impedance, density, Static Young's Modulus (vertical and horizontal), Static Poisson ratio (vertical and horizontal), and Static Shear Modulus (vertical). A deterministic solution or a statistical analysis such as Bayesian statistics can be used. Additionally, those well attributes may be scaled onto a user-defined grid within the 3-D volumes of elastic and reservoir properties of the subterranean formation.

The stress variation within the formation may be predicted in 3-D from finite element modeling. A quality control step may be performed on the predicted stress geometry using well data, or a calibration step can be conducted using stress measurements, if available.

From the 3-D stress state of the formation, the landing points of the laterals may be selected based on the reservoir quality and stress variation. A desirable landing point generally has zones with good reservoir quality and a low value of the least principal stress in a vertical direction. In some shale subterranean formations, a low value of acoustic impedance corresponds to high reservoir quality and low stress and can be used as a first estimation of the landing points.

The completion of selected wells within a formation, such as the number of stages along the laterals and the location of the perforation clusters within a stage, may be designed. Stages are selected to isolate relatively constant stress zones along a lateral and/or naturally fractured zones while avoiding any major faults. The perforation clusters are generally shot in the lowest stress zone within a stage.

A fracture propagation network model can be run to predict the created fracture surface area and the propped surface area resulting from a stimulation process. In new areas, the microseismicity can be used to calibrate the model and determine the fracture spacing and the stress contrast between the minimum principal stress and the intermediate principal stress, as described in US Patent Publication No. US 2010-0307755. Once the model has been calibrated in a new area, the model can be used without the need for microseismicity for adjacent wells such as other planned wells. The stress map provides the information used to constrain the fracture geometry, such as the fracture height.

The propped surface area or a detailed fracture conductivity map can be used in a production model to predict the production. It is efficient to use the matrix porosity and matrix permeability as obtained by the 3-D reservoir model in this production model. To validate the prediction, similar analysis can be done on existing wells. The prediction, either in terms of a fracture network propagation characteristic or production, can be correlated to the natural fracture attributes to find the relationship between the natural fracture azimuths and the production. The production of any particular well of interest, including production logging, provides a validation of the previous models.

A typical example of the use of an analytical model is shown below. Asymptotic analysis yields the following analytical model:

$$Q = 2A\bar{\rho}(p_r - p_w)\sqrt{\frac{c\phi_m k_m}{\pi\mu}}\left[1 - \exp\left(\frac{-L_m^2}{4\kappa t}\right)\right]\sqrt{t},$$

$$\kappa = \frac{k_m}{\phi_m \mu c}$$

where Q is the cumulative production, A is the productive surface area, $\bar{\rho}$ is a mean gas density, $\mu$ is the viscosity, $p_r$ is the reservoir pressure, $p_w$ is the well pressure, c is the compressibility, $\phi_m$ is the matrix porosity, $k_m$ is the matrix permeability, $L_m$ is half the matrix size, and t is the time. The pressures are known, except that the well pressure is assumed for a new well, $\phi_m$ and $k_m$ are obtained from the 3-D reservoir model maps, and the fluid properties are known. Therefore, one just needs to input A, which is as a first estimate the propped surface area as determined by a fracture network propagation model. The cumulative production may then be determined as a function of time.

Alternatively, the well production potential can be determined by the slope $\alpha$:

$$\alpha = 2A\bar{\rho}(p_r - p_w)\sqrt{\frac{c\phi_m k_m}{\pi\mu}}\left[1 - \exp\left(\frac{-L_m^2}{4\kappa t}\right)\right]$$

Generally, the higher the value of the slope, the better the well potential.

To validate the prediction, $\alpha$ can be measured using the production of existing wells (by plotting Q as a function of sqrt(t)), leading to an estimate of A that can be compared with the estimate of A from a fracture network production model. Production logging along a lateral of interest, and production of the well of interest for at least several months can be used to verify the approach.

The $\alpha$ parameter can also be correlated with other reservoir parameters such as the natural fracture density, number of acoustic events, reservoir quality parameters, and completion parameters.

A numerical reservoir model can also be used. In that case, the fracture network propagation model gives the fracture network to be discretized in the numerical reservoir simulator. As in the case of the analytical model, permeability and porosity are provided by the 3-D reservoir map. However, unlike the analytical model, the variation of these properties in the 3-D volume can be taken into account. The fracture network propagation model gives for each location along the fracture network the width of the fracture, and whether it is propped or not. In absence of proppant, a residual width is assumed to provide a residual hydraulic conductivity. This residual width could be assumed to be zero to retrieve the approach used for the analytical model. For the propped section, the fracture network propagation model gives the fracture hydraulic conductivity based on the proppant concentration, while in the analytical model the propped fracture conductivity is assumed infinite. At the start of production, the fractures are assumed to be filled with the water of the fracturing (slick water) job. The numerical reservoir model may be used to predict both the water flow back due to fracture water cleanup and the gas flow using multiphase flow modeling.

Other reservoir models and the production prediction models can be generated. For example, surface seismic data can help in determining fracture intensity, orientation, and saturating fluid.

Multiwave seismic exploration is usually performed in the mode of p-wave source and converted-wave receiver, i.e., PP and PS waves are the received data. Assuming a horizontal transverse isotropic (HTI) medium, PP wave and PS wave propagation is azimuthally dependent. In the case of PP waves, the difference between $V_{fast}$ and $V_{slow}$ (anisotropic velocity field components) can be empirically related to the fracture density. Azimuthal anisotropy also results in elastic properties (e.g., acoustic impedance, shear impedance, Poisson's ratio) being different, dependent on the azimuth.

PS wave propagation in an HTI medium results in the S-wave splitting into $V_{fast}$ and $V_{slow}$ components, whose difference is more pronounced than the PP difference. However, in practice PS acquisition is not done largely because of the cost of 3-component receivers and because the PS signal has a lower signal-to-noise ratio.

The approach can also give some clues about the uncertainty in the prediction: inversion of surface seismic data for acoustic and elastic properties (e.g., acoustic impedance, shear impedance, Poisson's ratio, density, permeability, porosity, etc. . . . ) is done using a deterministic approach. For known products, it is common to add probabilistic estimates by comparing predicted values to actual well measurements to estimate uncertainty. Inverted attributes are calibrated to predict (deterministically) reservoir attributes (e.g., TOC, porosity, Vclay, permeability) and elastic attributes (e.g., Young's Modulus, Shear Modulus, density) using a Neural Net. By introducing Bayesian statistics to the Neural Net prediction, it is possible to determine the uncertainty. For example, one can easily predict the probability of some reservoir and elastic property in terms of percentage. As new data are added, the probability distribution will change. Using Bayesian statistics in conjunction with Neural Net training will help judge the uncertainty of the prediction. This is particularly valuable to decide which new logs are needed to reduce the uncertainty and thus improve the production prediction.

Figure 2:
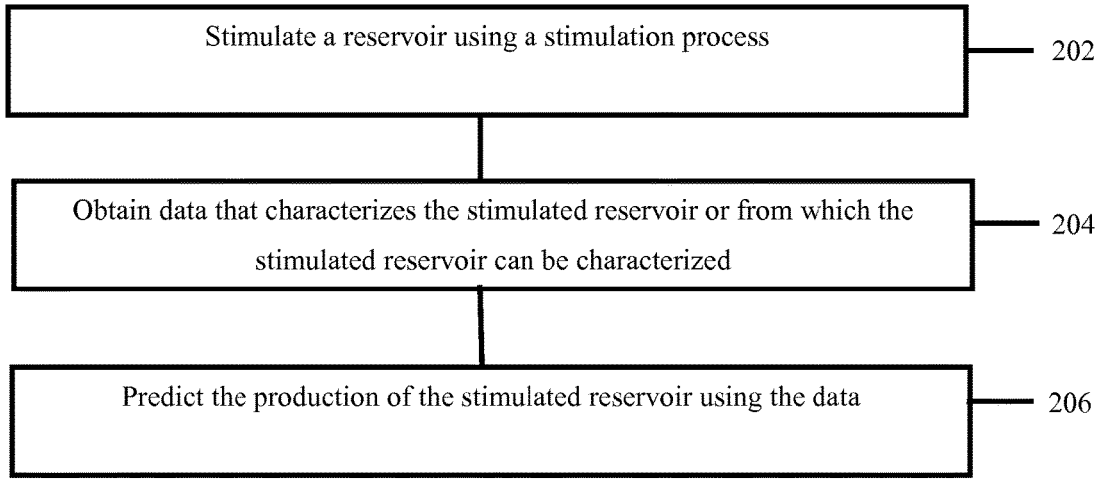
FIG. 2 is a flowchart showing one embodiment, in accordance with the present disclosure.

FIG. 1 show a system (100) having one ort more tools (102) capable of obtaining data that characterizes a stimulated reservoir or from which the stimulated reservoir can be characterized; and a processor (104) capable of predicting the production of the stimulated reservoir using the characterizing data and outputting the predicted production FIG. 2 shows an embodiment that includes stimulating a reservoir using a stimulation process (202); obtaining data that characterizes the stimulated reservoir or from which the stimulated reservoir can be characterized (204); and predicting the production of the stimulated reservoir using the data (206).

Figure 3:
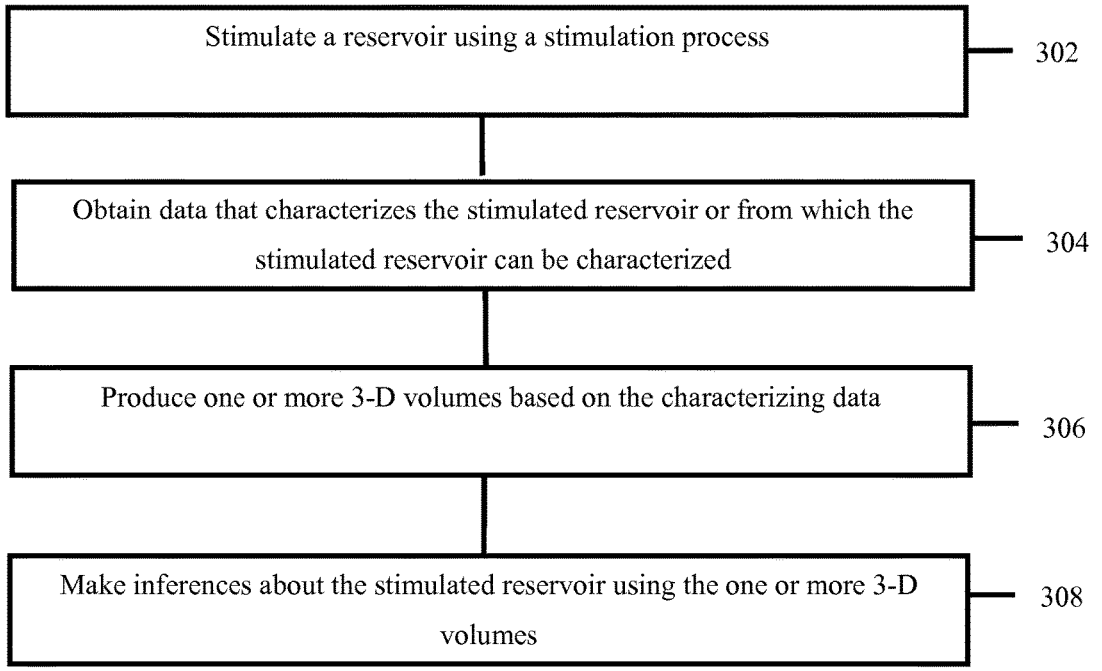
FIG. 3 is a flowchart showing an alternative embodiment, in accordance with the present disclosure.

FIG. 3 shows an embodiment that includes stimulating a reservoir using a stimulation process (302); obtaining data that characterizes the stimulated reservoir or from which the stimulated reservoir can be characterized (304); producing one or more 3-D volumes based on the characterizing data (306); and making inferences about the stimulated reservoir using the one or more 3-D volumes (308).

While only certain embodiments have been set forth, alternatives and modifications will be apparent from the above description to those skilled in the art. These and other alternatives are considered equivalents and within the scope of this disclosure and the appended claims. Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims. In the claims, means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112, paragraph 6 for any limitations of any of the claims herein, except for those in which the claim expressly uses the words 'means for' together with an associated function.

What is claimed is:

1. A method, comprising:

performing a hydraulic fracturing operation to stimulate a reservoir; obtaining data that characterizes the stimulated reservoir or from which the stimulated reservoir can be characterized, wherein a tool for obtaining the data comprises a pore pressure measurement tool that measures pore pressure;

using a neural net that employs Bayesian statistics to predict the production of the stimulated reservoir, wherein the neural net uses a field scale 3-D reservoir model incorporating the obtained data and the pore pressure, wherein the obtained data are selected from a group consisting of attributes inverted from seismic data, regional geology, well logs, and microseismic data, wherein the inverted attributes include one or more of elastic properties, reservoir properties, and azimuthal anisotropy properties, and wherein the seismic data is prestack seismic data;

producing 3-D volumes of elastic properties, reservoir properties, and fracture densities of the stimulated reservoir;

inputting the 3-D volumes of elastic properties and reservoir properties into a stress model, and predicting a 3-D stress state of a formation using an output of the stress model;

inputting the 3-D volumes of elastic properties and the 3-D stress state of the formation into a network fracture propagation model, and predicting a propped fracture surface area using an output of the network fracture propagation model;

and performing additional hydraulic fracturing operations in new wells in the stimulated reservoir.

2. The method of claim 1, further comprising determining a fracture conductivity of the stimulated reservoir using the predicted propped surface area.

3. The method of claim 2, further comprising inputting the fracture conductivity in a production model, and predicting the production from the stimulated reservoir.

4. A method, comprising:

performing a hydraulic fracturing operation to stimulate a reservoir; obtaining data that characterizes the stimulated reservoir or from which the stimulated reservoir can be characterized, wherein a tool for obtaining the data comprises a pore pressure measurement tool that measures pore pressure;

using a neural net that employs Bayesian statistics to predict the production of the stimulated reservoir, wherein the neural net uses a field scale 3-D reservoir model incorporating the obtained data and the pore pressure;

characterizing a stimulation treatment and predicting a productive surface area;

and performing additional hydraulic fracturing operations in new wells in the stimulated reservoir.

5. A system, comprising:

one or more tools capable of obtaining data that characterizes a stimulated reservoir or from which the stimulated reservoir can be characterized;

a pore pressure measurement tool for measuring pore pressure; and a processor capable of using a neural net that employs Bayesian statistics to predict the production of the stimulated reservoir using the characterizing data and the pore pressure, and outputting the predicted production, wherein the processor further uses a stress model, a network fracture propagation model, a determined fracture conductivity, and a production model to generate a field scale 3-D reservoir model.

* * * * *